US007577528B2

(12) United States Patent
Li et al.

(10) Patent No.: US 7,577,528 B2
(45) Date of Patent: Aug. 18, 2009

(54) SYSTEM AND METHOD FOR PUMP NOISE CANCELLATION IN MUD PULSE TELEMETRY

(75) Inventors: Jiang Li, Katy, TX (US); Hanno Reckmann, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/674,988

(22) Filed: Feb. 14, 2007

(65) Prior Publication Data

US 2007/0192031 A1 Aug. 16, 2007

Related U.S. Application Data

(60) Provisional application No. 60/777,343, filed on Feb. 28, 2006.

(51) Int. Cl.
*G01V 1/40* (2006.01)

(52) U.S. Cl. ..... 702/6

(58) Field of Classification Search ..... 702/6, 702/9, 11, 17, 47, 48, 50, 54–57, 66, 75, 702/93, 98, 100, 103, 104, 138, 183, 184, 702/188–191; 367/76, 81, 82, 83; 342/50; 73/290 V See application file for complete search history.

(56) References Cited

U.S. PATENT DOCUMENTS

| | | | | |
|---|---|---|---|---|
| 4,642,800 | A | 2/1987 | Umeda | 367/85 |
| 5,146,433 | A | 9/1992 | Kosmala et al. | 367/83 |
| 5,471,396 | A * | 11/1995 | White | 702/66 |
| 6,237,410 | B1 * | 5/2001 | Dyck et al. | 73/290 V |
| 6,741,185 | B2 | 5/2004 | Shi et al. | |
| 7,187,298 | B2 * | 3/2007 | Gardner et al. | 340/855.3 |
| 2002/0180613 | A1 | 12/2002 | Shi et al. | 340/853.1 |
| 2003/0061251 | A1 | 3/2003 | White | 708/300 |
| 2003/0218940 | A1 * | 11/2003 | Jogi et al. | 367/82 |
| 2004/0112642 | A1 * | 6/2004 | Krueger et al. | 175/57 |
| 2004/0155794 | A1 | 8/2004 | Gardner | 340/855.7 |

FOREIGN PATENT DOCUMENTS

| | | |
|---|---|---|
| EP | 0078907 | 5/1983 |
| GB | 2172460 | 9/1986 |
| WO | WO01/46548 | 6/2001 |

OTHER PUBLICATIONS

Martin Ruskowski et al.; *Compliance Cancellation for a Magnetic Guide Using a Smart Multitasking Active Vibration Control Algorithm*, JSME International Journal, Series C, vol. 46, No. 3, 2003, pp. 813-818.

M. Ruskowski et al.; "Enhanced Steady State Stiffness for a Magnetic Guide Using Smart Disturbance Compensation," Proc. of the 6th Int. Conference on Motion and Vibration Control, MOVIC2002, Tokyo, Japan, 2002, pp. 1098-1103.

* cited by examiner

*Primary Examiner*—Edward Raymond
*Assistant Examiner*—Mohamed Charioui
(74) *Attorney, Agent, or Firm*—Madan & Sriram, P.C.

(57) ABSTRACT

Pump noise in a mud-pulse telemetry system is reduced based on analysis of the frequency characteristics of the noise generated by one or more pumps. Least mean-squares filtering may be done. Alternatively, the frequency domain analysis of the pump frequencies is fine-tuned in the time domain and a synthetic timing signal is used for the filtering.

15 Claims, 6 Drawing Sheets

SYSTEM AND METHOD FOR PUMP NOISE CANCELLATION IN MUD PULSE TELEMETRY

CROSS-REFERENCES TO RELATED APPLICATIONS

This application claims priority from U.S. provisional patent application Ser. No. 60/777,343 filed on Feb. 28, 2006, and from U.S. provisional patent application Ser. No. 60/773,051 filed on Feb. 14, 2006.

BACKGROUND OF THE INVENTION

1. Field of the Invention

The present invention relates to drilling fluid telemetry systems, and, more particularly, to a system and method for reducing pump noise in a received telemetry signal.

2. Description of the Related Art

Drilling fluid telemetry systems, generally referred to as mud pulse systems, are particularly adapted for telemetry of information from the bottom of a borehole to the surface of the earth during oil well drilling operations. The information telemetered often includes, but is not limited to, operational parameters, such as, pressure, temperature, direction and deviation of the wellbore. Other parameter include logging data such as resistivity of the various layers, sonic density, porosity, induction, self potential and pressure gradients related to the reservoirs surrounding the wellbore. This information is critical to efficiency in the drilling operation and economic production of the reservoirs.

A number of different pulser types are known to those skilled in the art. These include, but are not limited to, poppet pursers for generating positive or negative pressure pulses; siren pursers for generating continuous wave pulse signals; and rotationally oscillating shear-valve pursers that may generate discrete pulses and/or continuous wave signals. Various encoding techniques are known in the art for transmitting data utilizing the described pulse signals. In general, all of these systems generate a pressure pulse by blocking or venting a portion of the drilling fluid flowing in the drill string to the bit. The generated pulse propagates to the surface where it is detected and decoded for further use. A major source of noise in the detected signal is a result of the large pressure pulses associated with the use of positive displacement, plunger type pumps utilized for pumping the drilling fluid through the system. Such pumps commonly generate pressure pulses 1-2 orders of magnitude greater than the detected pressure signals at the point of signal detection. In addition, the pump frequency is commonly within the range of the pulsed signal frequency.

The system and method of the present invention operate to reduce the pump noise in the received signal and provide enhanced signal detection and reliability.

SUMMARY OF THE INVENTION

One embodiment of the invention is a method of communicating a signal between a downhole location and a surface location. A pulsed variation is produced in a borehole fluid at the downhole location. A signal is measured at the surface location responsive to the pulsed variation. A frequency corresponding to at least one pump coupled to the mud channel is determined from the signal. A noise associated with the at least one pump is represented by a harmonic series including the determined frequency. The signal is adaptively filtered using the noise representation. The pulsed variation may be a pressure variation on a flow-rate variation. The pulsed variation may be representative of a property of the earth formation, and the method may further include making a measurement of the property using a formation evaluation sensor. The method may further include displaying the estimate of the property and/or distorting the estimate of the property on a suitable medium. Filtering of the signal may be done using a finite impulse response filter.

Another embodiment of the invention is an apparatus for communicating a signal from a downhole location to a surface location. The apparatus includes a signal source configured to produce a pulsed variation in a borehole fluid at the downhole location. The apparatus further includes a sensor at the surface location configured to produce a signal responsive to the pulsed variation. A processor is configured to determine from the signal a frequency corresponding to at least one pump coupled to the borehole fluid. The processor is further configured to represent a noise associated with the at least one pump by a harmonic series, and to adaptively filter the signal using the harmonic series and provide an estimate of the pulsed variation. The pulsed variation may be a pressure variation and/or a flow-rate variation. The apparatus may further include a formation evaluation sensor configured to make it measurement of the property of the earth formation, and the pulsed variation may be representative of the property of the formation. The processor may be further configured to use the estimate of the pulsed variation and provide an estimate of the property. The processor may be further configured to display the estimate of the property and/or store the estimate of the property on a suitable medium. The processor may be configured to filter the signal by using a finite impulse response filter.

Another embodiment of the invention is a computer-readable medium for use with an apparatus for communicating a signal from a downhole location to a surface location. The apparatus includes a signal source configured to produce a pulsed variation in a borehole fluid at a downhole location. The apparatus further includes a sensor at a surface location configured to produce a signal responsive to the pulsed variation. The medium includes instructions which enable a processor to determine from the signal a frequency corresponding to the at least one pump coupled to the borehole fluid, represent a noise associated with the at least one pump by a harmonic series, and adaptively filter the signal using the harmonic series and provide an estimate of the pulse variation. The medium may include a ROM, an EPROM, an EAROM, a flash memory, and/or an optical disk.

Another embodiment of the invention is a method of communicating between a downhole location and a surface location by producing pulsed variation in a borehole fluid at the downhole location. A signal is measured at the surface location responsive to the pulsed variation. A frequency corresponding to at least one pump coupled to the borehole fluid is determined from the measured signal in a frequency domain. An improved estimate of the frequency corresponding to the at least one pump is obtained in a time domain. The pulsed variation is filtered using the improved estimate of frequency corresponding to the at least one pump. The pulsed variation may be representative of a property of the earth formation, and a method may further include making a measurement of the property using a formation evaluation sensor. The method may further comprise processing the estimate of the pulse variation and providing an estimate of the property. The method may further include displaying the estimate of the property and/of storing the estimate of the property on a suitable medium. The pulsed variation may be representative of the condition of a bottomhole assembly in a borehole and thr method may further include measuring the condition of a bottomhole assembly.

Another embodiment of the invention is an apparatus for communicating between a downhole location and a surface location. The apparatus includes a signal source configured to produce a pulsed variation in a borehole fluid at a downhole location. The apparatus further includes a sensor configured to measure a signal at a surface location responsive to the pulsed variation. The apparatus also includes a processor configured to determine, in a frequency domain, a frequency corresponding to at least one pump coupled to the borehole fluid, obtain an improved estimate of the frequency corresponding to the at least one pump using a time domain method, and filter the signal using the improved estimate of frequency and an output of a timing signal generator operatively coupled to the at least one pump. The pulsed variation may be representative of the property of the earth formation and the apparatus may further include a formation evaluation sensor configured to make a measurement of the property. The processor may further be configured the use of the estimate of the pulsed variation and provide an estimate of the property. The processor may further be configured to display the estimate of the property and/of store the estimate of the property on a suitable medium. The pulsed variation may be representative of a condition of a bottomhole assembly and the apparatus may further include sensor configured to make the measurement of the property.

Another embodiment of the invention is a computer readable medium for use with an apparatus for communicating between a downhole location and a surface location, the apparatus including a signal source configured to produce a pulsed variation in a borehole in fluid at the downhole location, and a sensor at the surface location configured to measure a signal responsive to the pulsed variation. The medium includes instructions which enable a processor to determine in a frequency domain a frequency corresponding to at least one pump coupled to the borehole fluid, obtain an improved estimate of the frequency corresponding to the at least one pump using a time domain method, and filter the signal using the improved estimate of the frequency and an output of a timing signal generator operatively coupled to the at least one pump.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF EMBODIMENTS

Figure 1:
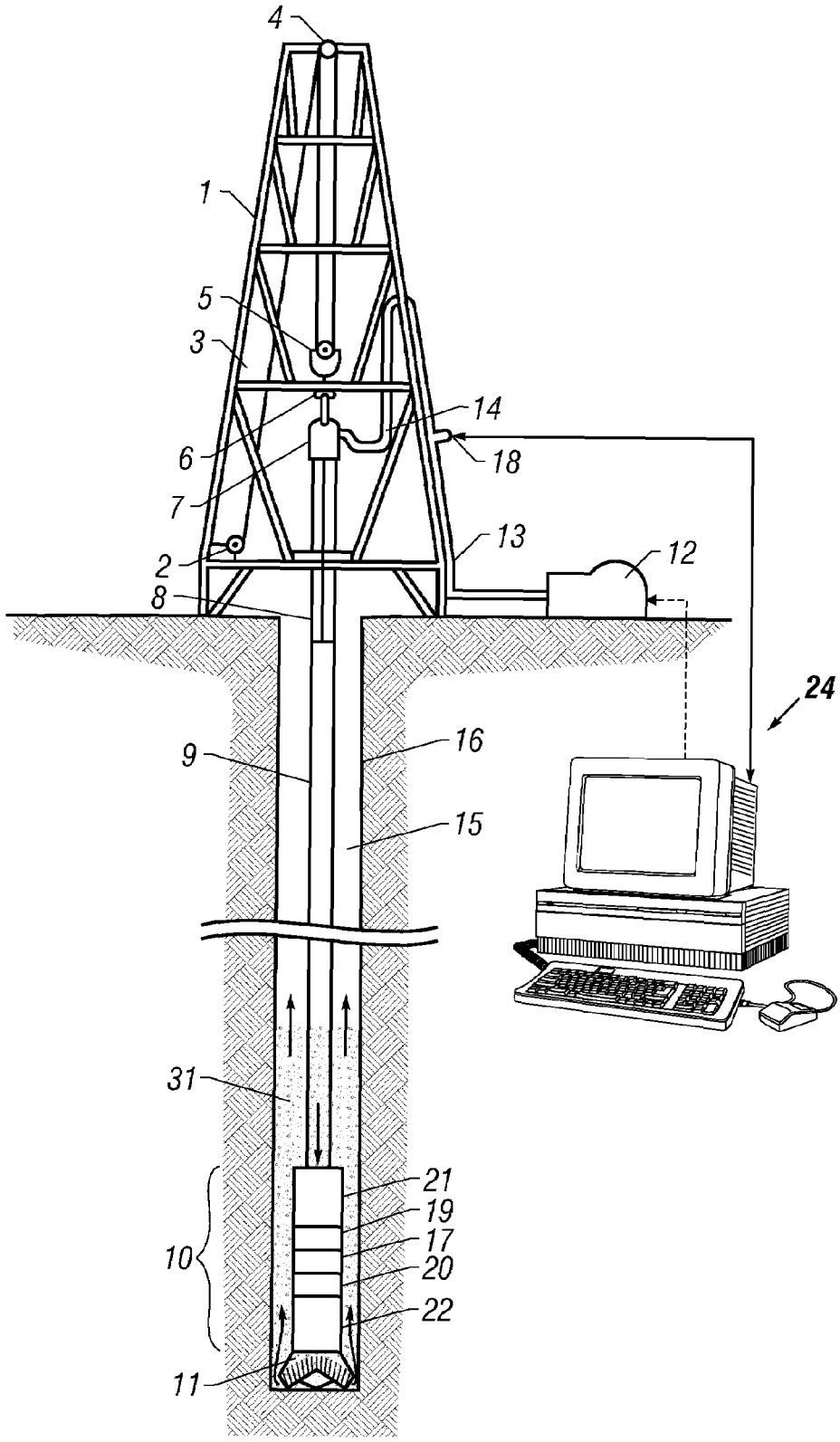
FIG. 1 shows a drilling system according to one embodiment of the present invention.

FIG. 1 is a schematic diagram showing a drilling rig 1 engaged in drilling operations. Drilling fluid 31, also called drilling mud, is circulated by pump 12 through the drill string 9 down through the bottom hole assembly (BHA) 10, through the drill bit 11 and back to the surface through the annulus 15 between the drill string 9 and the borehole wall 16. Commonly, pump 12 is a positive displacement pump, such as a triplex plunger pump. As one skilled in the art will appreciate, such a pump causes pressure spikes in the drilling fluid with a fundamental frequency related to the RPM of the pump driver. The BHA 10 may comprise any of a number of sensor modules 17, 20, 22 which may include, for example, formation evaluation sensors and directional sensors. These sensors are well known in the art and are not described further. The BHA 10 also contains a pulser assembly 19 which induces pressure fluctuations in the mud flow. The pressure fluctuations, or pulses, propagate to the surface through the mud flow in the drill string 9 and are detected at the surface by a sensor 18 and a control unit 24. Control unit 24 includes, but is not limited to, electronic circuits for interfacing with sensor 18 and a processor and memory for executing instructions related recovering signals transmitted by pulser 19. The sensor 18 is connected to the flow line 13 and may comprise at least one of a pressure sensor, a flow sensor, and a combination of a pressure sensor and a flow sensor. As one skilled in the art will appreciate, the pressure pulse has an associated fluid velocity pulse that also propagates through the drilling fluid and may be detected and decoded. It should be noted that instead of pressure variations, a pulser can be used to generate flow rate variations. Collectively, such pressure variations and flow rate variations are referred to as pulsed variations.

The present invention comprises a system and a method for pump noise cancellation (PNC) in mud pulse telemetry. As used herein, the term pump noise cancellation means a substantial reduction of pump noise in the detected telemetry signal. The system is able to identify one or more fundamental frequencies of harmonic pump noise in a received pressure pulse telemetry signal, based on certain operational input information. The operational input information includes, but is not limited to: the number of pumps; the expected operating frequency of the pumps; and the number of harmonics to remove. A reference signal containing the identified fundamental frequencies and their harmonics is generated to simulate the harmonic pump noise. The reference signal, along with the received telemetry signal, is passed through an adaptive least mean square (LMS) filter system, where the pump noise can be adaptively tracked. After successive adaptive iterations, the output of the LMS filter converges to an acceptable approximation of the harmonic pump noise in the LMS sense. Finally, a pump noise reduced signal is obtained by subtracting the pump noise approximation from the received telemetry signal.

Figure 2:
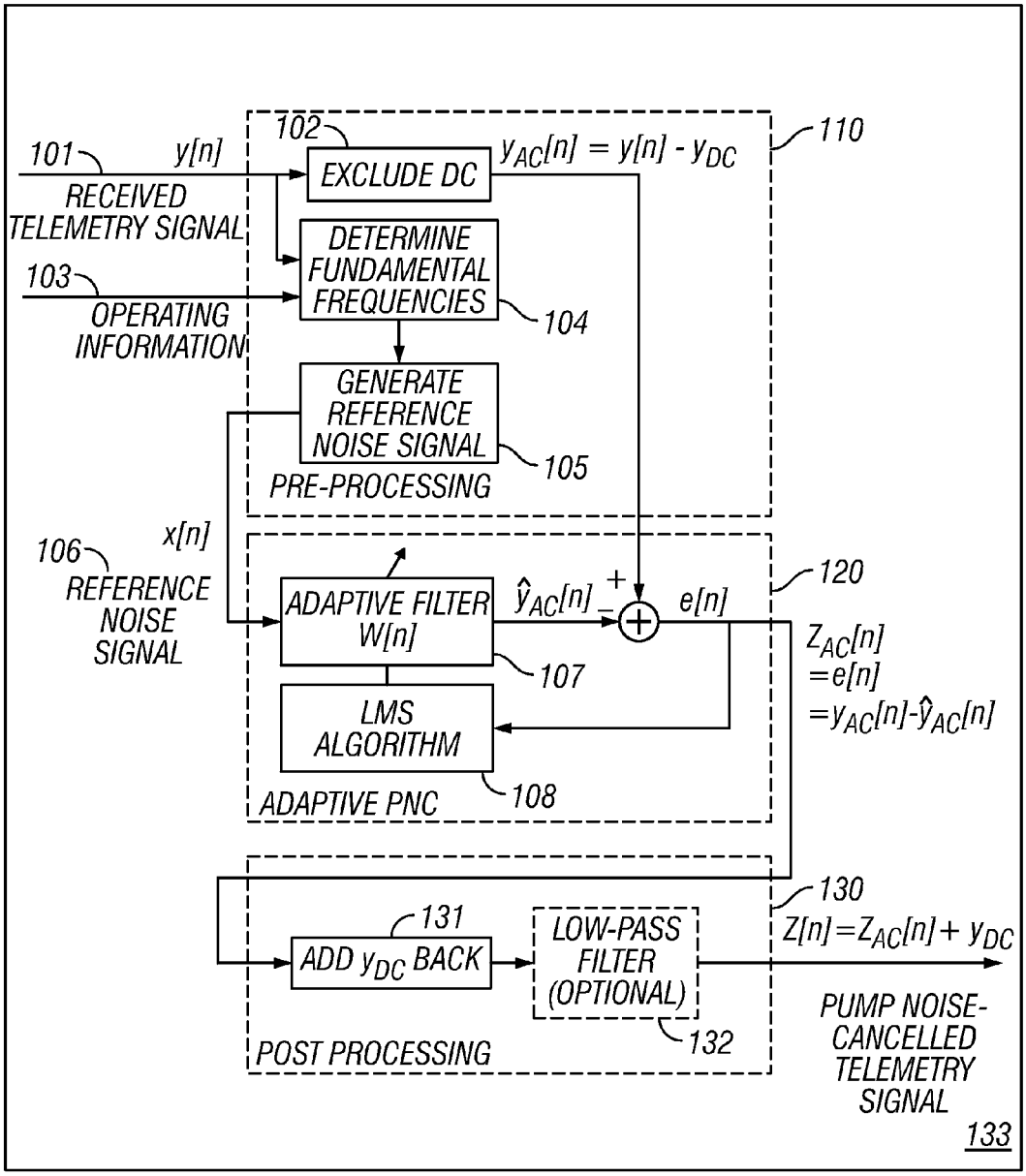
FIG. 2 shows a system block diagram of the pump noise reduction system.

In one embodiment, the automated PNC technique, see FIG. 2, comprises instructions in a processor in control unit 24. The instructions include, but are not limited to, three modules for recovering the transmitted pulse signal: (i) preprocessing 110; (ii) adaptive PNC 120; and (iii) post-processing 130. The nature of the signal sensed from sensor 18 depends on the type of sensor used. For example, if sensor 18 is a total pressure sensor, then the signal from sensor 18 commonly contains a static pressure component, representing the baseline pump pressure, as well as a dynamic component, representing the encoded pressure pulses and the pump generated noise. The static pressure signal is immaterial to the telemetry function and is commonly removed for detection of the pulses. The telemetry signal 101 from sensor 18 is initially processed 102 to remove static pressure, also called DC component, so as to perform further processing on substantially only the pressure pulse. The removal of the DC component may be done in either analog circuitry or done digitally.

Operating information (e.g., given frequency ranges where the fundamental frequencies likely appear) 103 is input into the system. In one embodiment the system determines the fundamental frequencies of the telemetry signal 104, by using, for example, Fourier transforms, on the telemetry signal 101. While the operating system could identify the fundamental frequencies obtained from other sources, this searching technique has an advantage of tolerating drifts of the fundamental frequencies. Such drift is common, for example, as the pump operating speed may drift causing a drift in the fundamental pump frequency. The pump noise at the fundamental frequency typically appears as a large-amplitude spike in the calculated frequency spectrum. The system searches for a maximum value in the given frequency range, and identifies the frequency corresponding to this maximum value as the fundamental frequency. For multiple fundamental frequencies, for example for multiple pumps, the system may search for more than one spike in the given frequency range, or one spike in each of multiple given frequency ranges.

A reference noise signal 106 is generated 105 using the determined fundamental noise frequencies. Assuming that the pump noise is harmonic, the following mathematical model is used for the reference noise signal 106, $$x[n] = \sum_{l=1}^{L}\sum_{k=1}^{K}[A_{k,l}\cos(2\pi f_{0,l}nkl + \theta_{k,l}) + B_{k,l}\sin(2\pi f_{0,l}nkl + \phi_{k,l})], \tag{1}$$

where $f_{0,l}$ (for l=1,2, . . . L) are L fundamental frequencies of pump noises, K is the total number of harmonics to be used for the noise cancellation, and $A_{k,l}$, $B_{k,l}$, $\theta_{k,l}$ and $\phi_{k,l}$ (for l=1,2, . . . L and k=1,2, . . . K) are initial amplitude and phase constant numbers for sinusoid signals, respectively.

In one aspect of the adaptive PNC module, the LMS adaptive algorithm may be used to suppress harmonic pump noises. In general, the adaptive filter 107 and the LMS algorithm 108 aim to minimize the mean square error (MSE) of a signal estimate by iteratively adjusting a set of adaptive filter coefficients. Three basic operations for the LMS algorithm are as follows:

Step 1: Filtering $$\hat{y}[n] = \vec{w}^H[n-1]\,\vec{x}[n] \tag{2}$$

Step 2: Error Formation $$e[n] = y[n] - \hat{y}[n] \tag{3}$$

Step 3: Coefficient Updating $$\vec{w}[n] = \vec{w}[n-1] + 2\mu\,\vec{x}[n]e^*[n] \tag{4}$$

where $\vec{w}[n] = \{w_0[n], w_1[n], \ldots, w_{M-1}[n]\}^T$ contains the adaptive filter coefficients, $\vec{x}[n] = \{x[n], x[n-1], \ldots, x[n-M+1]]\}^T$ is the filter input, $\hat{y}[n]$ is the filter output, y[n] is the desired signal, e[n] is the error signal as deviation of $\hat{y}[n]$ from y[n], and μ is an adaptation constant (or stepsize). Superscript H represents a complex conjugate transpose, superscript * represents a complex conjugate, superscript T represents a real transpose, constant M is the filter length, and n is time index.

In one embodiment, the adaptive filter 107, $\vec{w}[n]$, is a finite impulse response (FIR) filter. An FIR filter provides inherent stability and linear phase properties. The filter length, M, is one of the design parameter for using the LMS algorithm. Also, note that equations (2)-(4) indicate the adaptive filter outputs at time n depend not only on the inputs at time n, but also the inputs at the times n−1 until n−M+1. For a causal system, these inputs are totally or partly not available when n=0,1 . . . , M−2, and are typically set to zeros in practical applications. Another key design parameter for the LMS algorithm is the adaptive stepsize, μ. In general, in order to guarantee the convergence of the LMS adaptation algorithm, μ has to satisfy the following condition, $$0 < \mu < \frac{1}{P_T}, \tag{5}$$

where $P_T$ is the total input power. For simplicity $$\mu = \frac{1}{qP_T}, \tag{6}$$

where q>1 is any real number that can be initially set up. Based on telemetry signal characteristics, these two design parameters, M and q, may be empirically chosen.

In post-processing module 130, the DC component of input telemetry signal 101 is added back to obtain the final pump noise-cancelled telemetry signal 133. In some cases only low-frequency components of the signal are of interest, and a low-pass filter 132 can be applied to the pump noise-cancelled signal.

The automated PNC system described in FIG. 2 is able to operate substantially autonomously after operating system parameters 103 are initially set up. The system processes a certain size of telemetry data each time. As new telemetry data come in, the system can update the PNC results every N≧1 samples. This updating includes searching for new fundamental frequencies of the pump noises, generating new reference noise signals, and updating the adaptive filter coefficients. It is because of this updating that the system is able to track the drifting of the fundamental frequencies. The system operates in real time when every sample is updated. If updating is done every N>1 samples, the system has a time delay of N samples. This procedure can be thought of as a sliding window operation. The window size, W, is equal to the size of currently processed telemetry data, and the shifting stepsize of the window, s, is equal to N. At the very beginning of the operation, the system waits for W samples to start the automated PNC operation. After this waiting period, the system can operates in real time (s=N=1) or, alternatively, with a time delay of s=N>1 samples. Note that the adaptive LMS filter outputs at times n=0,1 . . . , M−2 are not reliable. To avoid this problem, the sliding window is extended to include previous M−1 samples for the system input, but to neglect the first M−1 samples in the system output.

Regarding the window size, first, a longer window results in longer system delay, which is usually not allowable in practical telemetry applications. Second, a shorter window degrades the spectral resolution and thus the accuracy of the fundamental frequency determination in the pre-processing module. Moreover, a shorter window reduces the number of adaptive iterations and thus the accuracy of harmonic pump noise estimates in the adaptive PNC module. Therefore, the window size is chosen according to the requirements of the telemetry application.

Table I, in one aspect, summarizes the system parameters that are required for initial setup. These parameters are grouped into three categories. The first category comprises parameters for adaptive filter 107, including the adaptive filter length and the adaptation stepsize. The second category includes parameters for reference noise signal, including operating information for obtaining fundamental frequencies, such as, the number of fundamental frequencies, the number of harmonics corresponding to each fundamental frequency, and initial amplitude and phase values for each harmonic. The third category includes parameters for system operation, including the length of the operating window and the shifting stepsize of the window.

Figure 3:
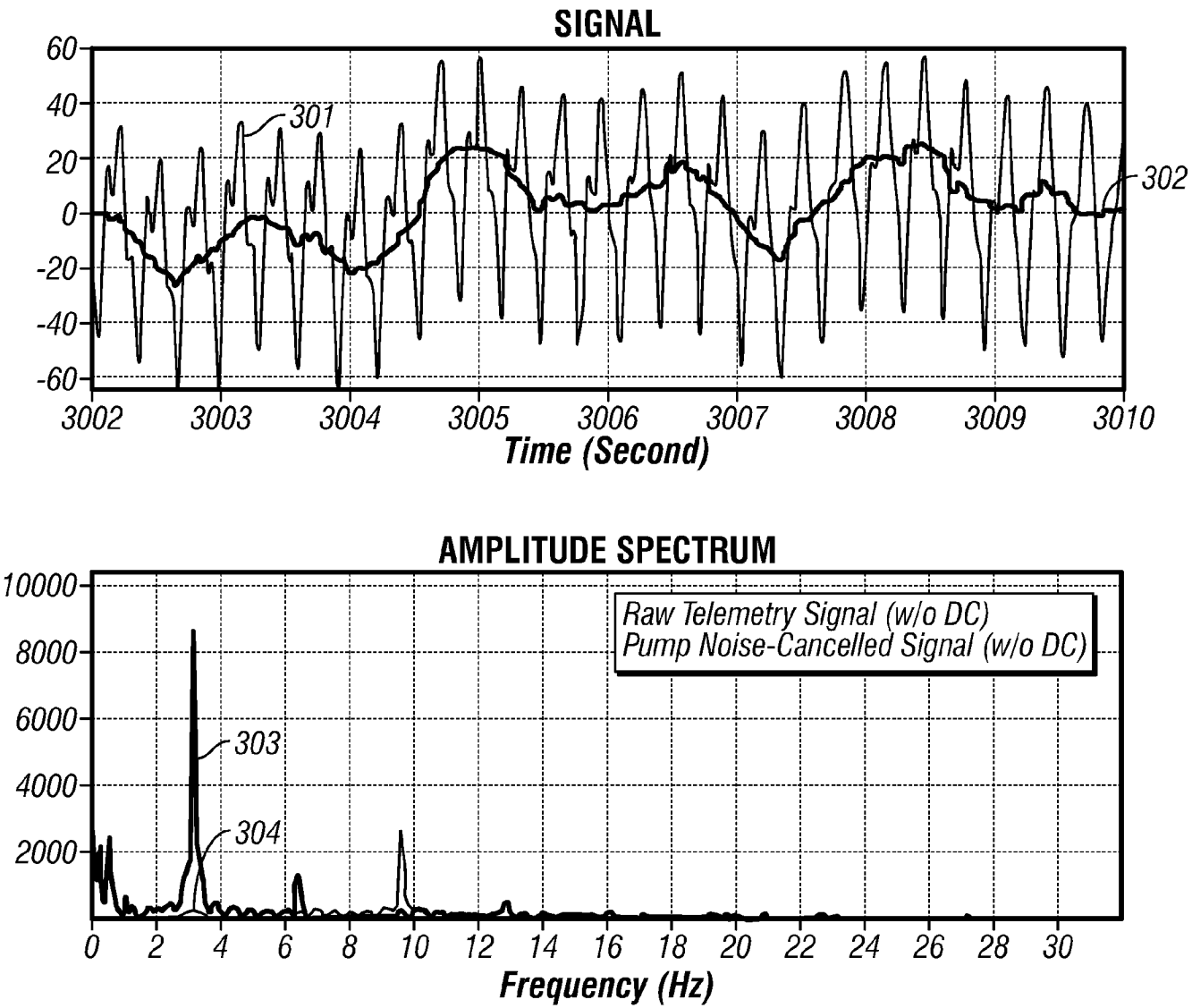
FIG. 3 shows a raw telemetry signal as compared to a signal processed according to the present invention.
Figure 4:
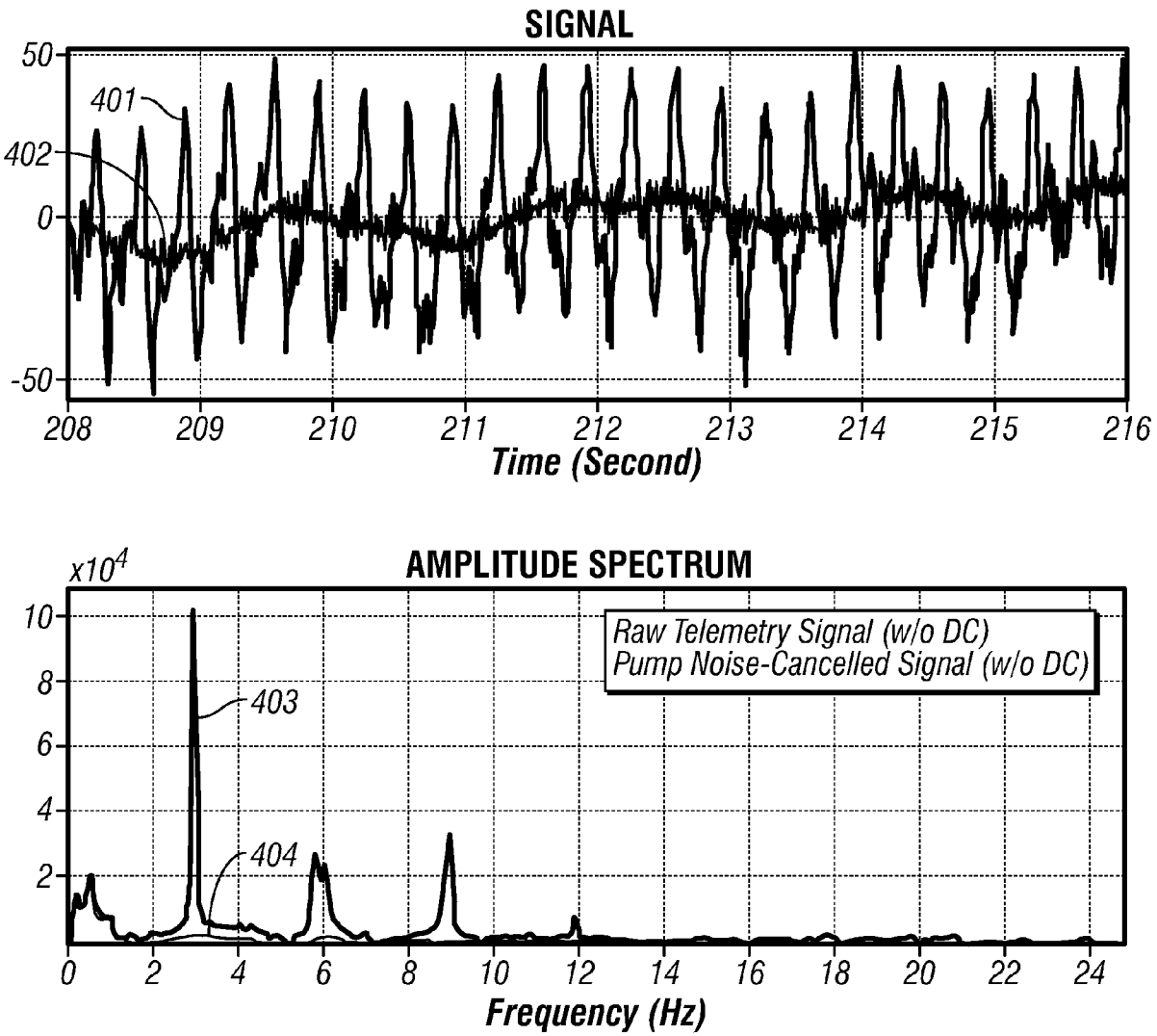
FIG. 4 shows another raw telemetry signal as compared to a signal processed according to the present invention.

FIGS. 3 and 4 show the automated PNC method as tested on two sets of real telemetry data contaminated by pump noises. Sampling rates for the two sets of data are 64 Hz (FIG. 3) and 1000 Hz (FIG. 4), respectively. Pulse width is 0.8 seconds for both data sets. All the initial parameters for the system have been empirically determined and summarized in Table II. Primary testing results are shown in FIGS. 3 and 4, where the investigated data length is 8 seconds. The upper part of each figure shows the raw telemetry signals 301 and 401 and the pump noise-cancelled signals 302 and 402 in the time domain. The lower part shows their Fourier spectra indicating that in the raw telemetry signals, there is significant pump noise 303 and 403 at about 3 Hz. It can be easily seen that the pump noise 304 and 404 has been greatly suppressed after applying the automated PNC method, and the pulses 302 and 402 can be clearly observed. Note that for a clear demonstration of the PNC results the DC component and higher-frequency components of Fourier spectra are not shown.

The foregoing discussion is primarily addressed to detecting pressure pulses using a pressure sensor. It will be apparent to one skilled in the art, that a flow sensor may be used alternatively to detect the pressure pulses, based on the well known waterhammer relationship, wherein, $$dp/dV=-\rho a \tag{7}$$

where V is fluid volume, ρ is fluid density, and a is fluid sound speed.

Figure 5:
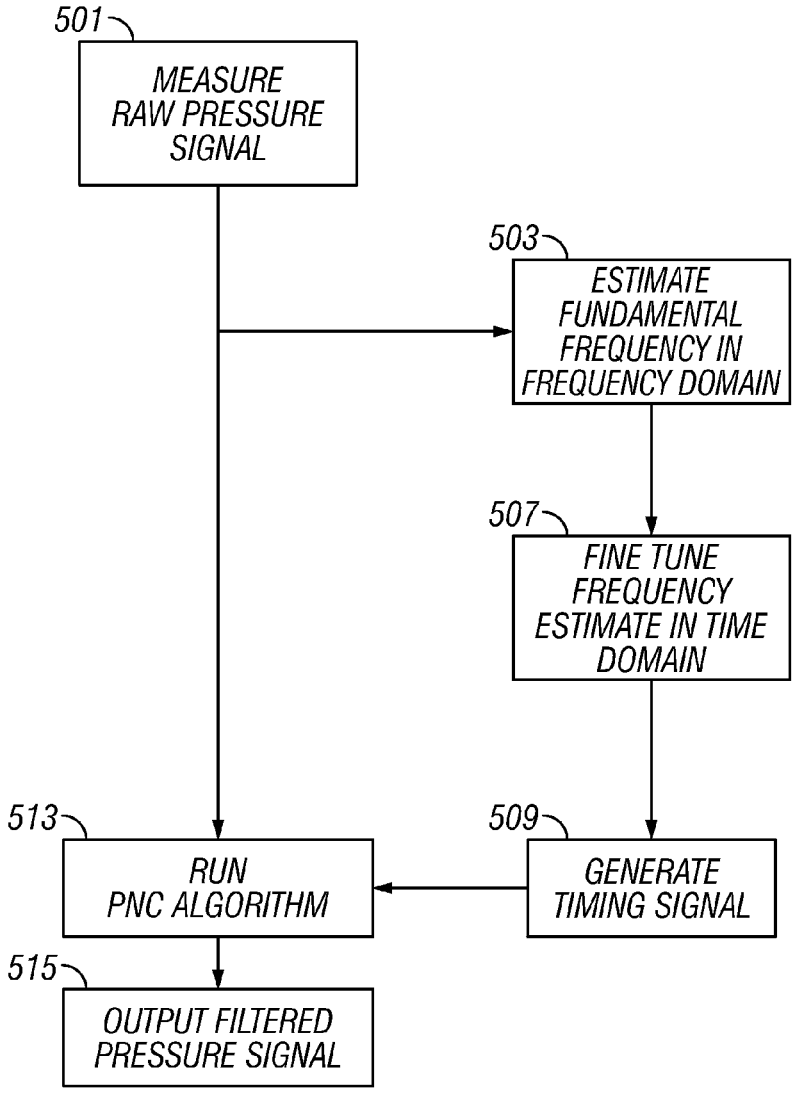
FIG. 5 is a flow chart of an alternate embodiment of the invention using synthetic timing signal.

Another embodiment of the invention is illustrated in FIG. 5. Fluid pressure signals 501 are measured and a fundamental estimation of frequency components is done in the time domain 503. This may be done using a FFT algorithm and identification of maxima in the frequency spectrum.

In the frequency domain, the identified maxima in the spectra correspond to the frequency of operation of each of the pumps. In addition, there may also be maxima corresponding to harmonics of the frequency of operation (fundamental frequency) of each of the pumps. Such harmonics are inherent in the operation of most oscillatory mechanical systems. In addition, there may also be measurement noise present in the frequency spectrum.

The frequencies at which peaks are present in the spectrum are then analyzed to identify a specific frequency which could be the fundamental frequency (or frequencies) of the pump(s). This identification is based on the fact that the harmonic frequencies would be integer multiples of the fundamental frequency.

The identified pump frequencies are then fine tuned 507 using a time domain method. This method is described in detail in Ruskowski et al (JSME International Journal Series C: Mechanical Systems,Machine Elements and Manufacturing, Volume 46, No. 3 September 2003) and uses a difference equation using three successive samples.

$$\Omega = \omega\Delta T = \cos^{-1}\left\{\frac{p(k)+p(k-2)}{2p(k-1)}\right\}, \tag{8}$$

where ΔT is the sample interval in time and ω is the frequency where the p's are pressure samples. One further improvement of the time domain method would be to fine tune the frequency of a known harmonic of the fundamental since this would increase the resolution and the speed of the method. Afterwards the fundamental can be regained from the known harmonic.

Based on the identified fundamental frequencies, a timing signal generator 509 outputs a timing signal which is indicative of the movement of a pump cylinder, e.g., an indication of the time at which the pump cylinder is at a specific point in its motion. Suitable coupling is provided between the pump and a timing signal generator. This timing signal is then used by a pump noise cancellation algorithm 513 to give a filtered pressure signal 515, in which the pump noise has been removed. Typically, the timing signal is obtained by using an electromechanical transducer for each pump. In the present invention, however, the timing signal is generated based on the frequency analysis.

The signature for each pump is assembled by marking the time at which successive timing signals occur, and stacking the pressure records between the timing signals. This results in random noise being cancelled out, and the pump signature emerges. This pump signature is then subtracted from the raw pressure data; the result is the measured pressure signal with the signal from the pump cancelled out. In the ideal case, which occurs quite often, this resultant signal contains only the signal from pulser. For additional details, refer to U.S. Pat. No. 4,642,800, which is incorporated herein by reference. A point of novelty of the present invention is that instead of using the output of a transducer to provide the timing signal, a synthetic timing signal is generated using the pressure measurements.

Figure 6:
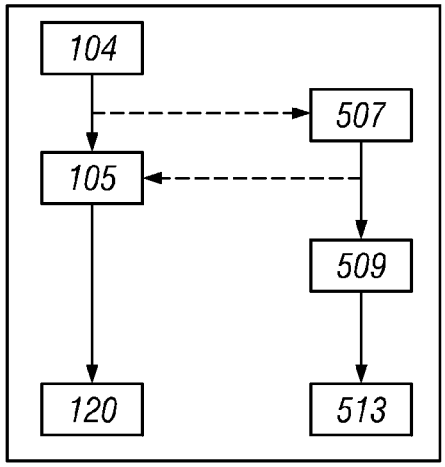
FIG. 6 shows the relationship between elements of FIG. 5 and FIG. 2.
Figure 7:
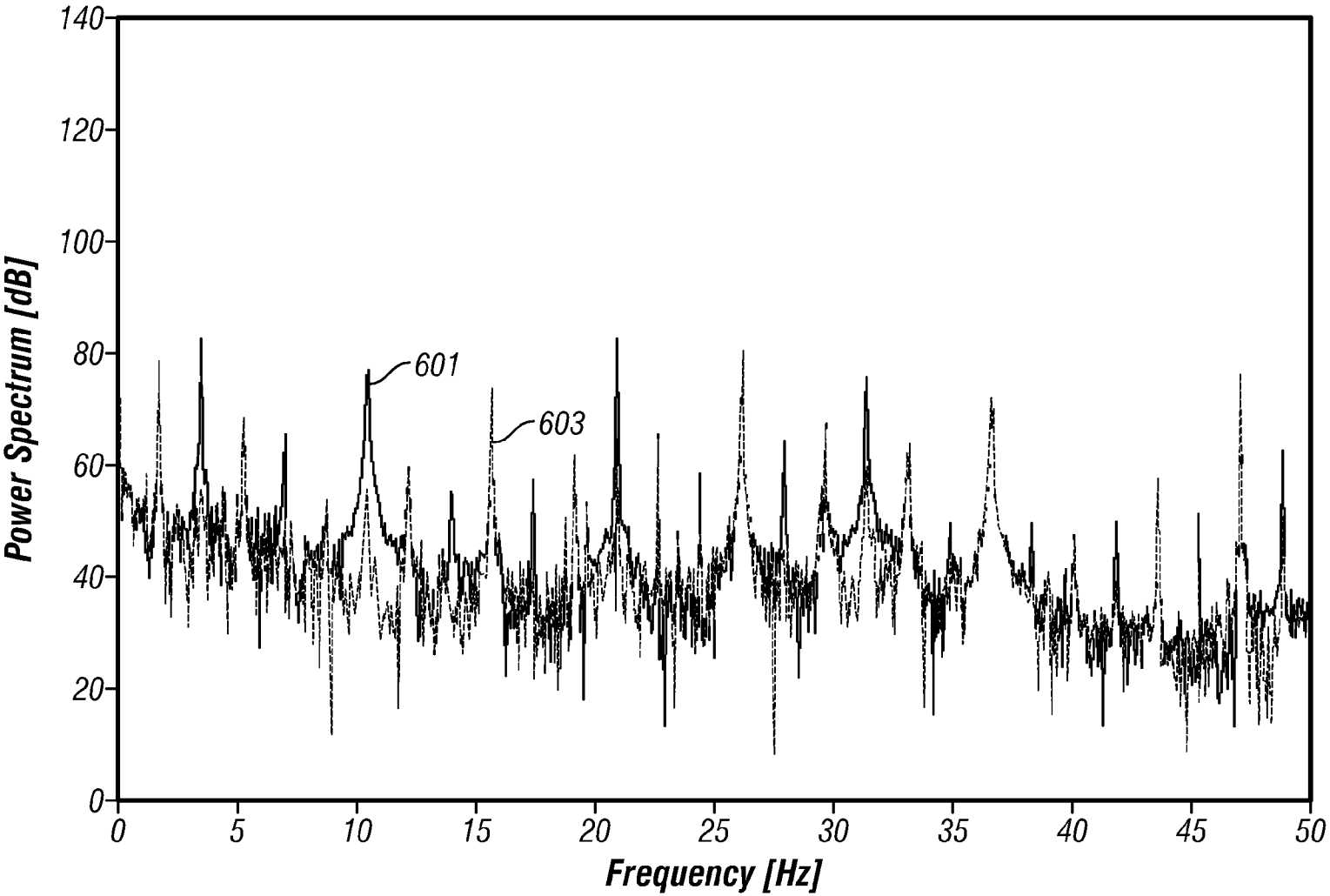
FIG. 7 shows an example of results obtained using the present invention.

FIG. 6 establishes a connection between the noise cancellation method in FIG. 2 above and the method in FIG. 5. The fundamental frequencies estimated in 104 could be further adjusted by using the frequency fine tuning method in 507. The output from 507 can then be fed-back to 105 for generating the reference noise signal. From this point, one can choose to use either the PNC algorithm 513 or the adaptive PNC algorithm 120 to implement the pump noise cancellation.

After the cancellation of the pump noise, the estimate of the pulsed variation may be further processed to provide an estimate of a value of the downhole measurement. The measurements may then be displayed or stored on a suitable recording medium. The downhole measurement may correspond to a property of the earth formation measured by a formation evaluation sensor. The downhole measurement may also correspond to an operating condition of the bottom hole assembly, such as weight on bit, rate of penetration, whirl, torque, the rotational speed of the drill bit, pressure, temperature and/or survey information about the borehole.

The operation of the transmitter and receivers may be controlled by the downhole processor and/or the surface processor. Implicit in the control and processing of the data is the use of a computer program on a suitable machine readable medium that enables the processor to perform the control and processing. The machine readable medium may include ROMs, EPROMs, EAROMs, Flash Memories and Optical disks. The computer program included instructions to perform any of the methodologies described herein.

The foregoing description is directed to particular embodiments of the present invention for the purpose of illustration and explanation. It will be apparent, however, to one skilled in the art that many modifications and changes to the embodiment set forth above are possible. It is intended that the following claims be interpreted to embrace all such modifications and changes.

TABLE I

| System parameters that need to be initially set up for automated PNC method. |
|---|
| 1. Parameters for adaptive filter |
| (1) The length of the FIR adaptive filter |
| (2) The adaptive constant (or stepsize) |
| 2. Parameters for reference noise signal |
| (1) The given frequency ranges for determining fundamental frequencies |
| (2) The number of fundamental frequencies |
| (3) The number of harmonics corresponding to each fundamental frequency |
| (4) The initial amplitude and phase values for each harmonic |
| 3. Parameters for system operation |
| (1) The length of the operating window |
| (2) The shifting stepsize of the operating window |

TABLE II

Initial parameters used for testing the automated PNC method.

| | Data sampling rate = 64 Hz | Data sampling rate = 1000 Hz |
|---|---|---|
| 1. Parameters for adaptive filter | (1) M = 128<br>(2) q = 4 | (1) M = 500<br>(2) q = 8 |
| 2. Parameters for reference noise signal | (1) 2 < f < 5 Hz<br>(2) L = 1<br>(3) K = 5<br>(4) $A_{k,l} = B_{k,l} = 1$<br>$\theta_{k,l} = \phi_{k,l} = 0$<br>for l = 1, 2, . . . L and k = 1, 2, . . . K | (1) 2 < f < 5 Hz<br>(2) L = 1<br>(3) K = 5<br>(4) $A_{k,l} = B_{k,l} = 1$<br>$\theta_{k,l} = \phi_{k,l} = 0$<br>for l = 1, 2, . . . L and k = 1, 2, . . . K |
| 3. Parameters for system operation | (1) W = 512 samples = 8 seconds<br>(2) s = W | (1) W = 8000 samples = 8 seconds<br>(2) s = W |

The invention claimed is:

1. A method of communicating between a downhole location and a surface location, the method comprising:

inducing a pulsed variation in a borehole fluid at the downhole location;

measuring a signal at the surface location responsive to the pulsed variation;

estimating, in a frequency domain, a fundamental frequency corresponding to at least one pump coupled to the borehole fluid;

using a time domain method for improving the estimate of the fundamental frequency; and filtering the signal using the improved estimate of fundamental frequency corresponding to the at least one pump and a timing signal obtained from the measured signal.

2. The method of claim 1 wherein the pulsed variation is representative of a property of the earth formation, the method further comprising making a measurement of the property using a formation evaluation sensor.

3. The method of claim 2 further comprising processing the estimate of the pulsed variation and providing an estimate of the property.

4. The method of claim 3 further comprising at least one of: (i) displaying the estimate of the property, and (ii) storing the estimate of the property on a suitable medium.

5. The method of claim 1 wherein the pulsed variation is representative of a condition of a bottomhole assembly at the downhole location, the method further comprising making a measurement of the condition.

6. The method of claim 1 wherein using the time domain method further comprises using a relationship of the form:

$$\Omega = \omega\Delta T = \cos^{-1}\left\{\frac{p(k) + p(k-2)}{2p(k-1)}\right\}$$

where Ω is a normalized angular frequency, ΔT is the sample interval in time, ω is the frequency where the p's are pressure samples, and k is an index.

7. An apparatus for communicating between a downhole location and a surface location, the apparatus comprising:

a signal source configured to induce a pulsed variation in a borehole fluid at the downhole location;

a sensor configured to measure a signal at the surface location responsive to the pulsed variation; and a processor configured to:

(A) estimate from the measured signal a fundamental frequency corresponding to at least one pump coupled to the borehole fluid, (B) use a time domain method to improve the estimate of the fundamental frequency, and (C) filter the signal using the improved estimate of fundamental frequency corresponding to the at least one pump and a timing signal obtained from the measured signal.

8. The apparatus of claim 7 wherein the pulsed variation is representative of a property of the earth formation, the apparatus further comprising a formation evaluation sensor configured to make a measurement of the property.

9. The apparatus of claim 8 wherein the processor is further configured to use the estimate of the pulsed variation and provide an estimate of the property.

10. The apparatus of claim 9 wherein the processor is further configured to at least one of: (i) display the estimate of the property, and (ii) store the estimate of the property on a suitable medium.

11. The apparatus of claim 7 wherein the pulsed variation is representative of a condition of a bottomhole assembly, the apparatus further comprising a sensor configured to make a measurement of the property.

12. A computer-readable medium accessible to a processor, the computer-readable medium including instructions which enable the processor to use a signal at a surface location responsive to a pulsed variation induced in a borehole fluid at the downhole location to:

estimate a fundamental frequency coffesponding to at least one pump coupled to the borehole fluid;

use a time domain method to improve the estimate of the fundamental frequency; and filter the signal responsive to the pulsed variation using the improved estimate of the fundamental frequency corresponding to the at least one pump and a timing signal obtained from the measured signal.

13. The medium of claim 12 further comprising at least one of: (i) a ROM, (ii) an EPROM, (iii) an EAROM, (iv) a flash memory, and (v) an optical disk.

14. The method of claim 1 wherein the pulsed variation is representative of a condition of a bottomhole assembly at the downhole location, the method further comprising making a measurement of the condition.

15. The computer-readable medium of claim 12 further comprising instructions that enable the processor to make use of a signal responsive to a pulsed variation that is at least one of: (i) a pressure variation, and (ii) a flow-rate variation.

* * * * *

UNITED STATES PATENT AND TRADEMARK OFFICE

CERTIFICATE OF CORRECTION

PATENT NO. : 7,577,528 B2
APPLICATION NO. : 11/674988
DATED : August 18, 2009
INVENTOR(S) : Jiang Li and Hanno Reckmann It is certified that error appears in the above-identified patent and that said Letters Patent is hereby corrected as shown below:

Column 9, claim 3, line 56, delete "processing the", insert --processing a--;

Column 10, claim 9, line 51, delete "the estimate", insert --an estimate--;

Column 10, claim 12, line 66, delete "coffesponding", insert --corresponding--; and Column 12, claim 15, line 7, delete "a signal responsive to a pulsed", insert --the signal responsive to the pulsed--.

Signed and Sealed this

First Day of June, 2010

David J. Kappos

David J. Kappos
*Director of the United States Patent and Trademark Office*